United States Patent [19]

Comparetti

[11] Patent Number: 4,969,218

[45] Date of Patent: Nov. 13, 1990

[54] SEMI-FLUSH KIT

[76] Inventor: Joseph Comparetti, 23 Cedar Grove Ave., Lake Ronkonkoma, N.Y. 11779

[21] Appl. No.: 201,471

[22] Filed: Jun. 2, 1988

[51] Int. Cl.[5] ..... E03D 1/34

[52] U.S. Cl. ..... 4/325; 4/324

[58] Field of Search ..... 4/325, 324, 326, 327, 4/394, 395, 396, 397, 398, 399, 400, 401

[56] References Cited

U.S. PATENT DOCUMENTS

| | | | |
|---|---|---|---|
| 3,775,778 | 12/1973 | Lee | 4/325 |
| 4,025,968 | 5/1977 | Davis | 4/325 |
| 4,080,669 | 3/1978 | Biggerstaff | 4/325 |
| 4,232,408 | 11/1980 | Chen-Yuan | 4/325 |
| 4,483,024 | 11/1984 | Troeh | 4/325 |
| 4,620,331 | 11/1986 | Sagucio | 4/325 |

*Primary Examiner*—Henry J. Recla
*Assistant Examiner*—Edward C. Donovan
*Attorney, Agent, or Firm*—Richard L. Miller

[57] ABSTRACT

This semi-flush kit is designed for employment with a simple high buoyancy flush valve toilet tanks. Primarily, it consists of two main floats and each are controlled by a right and left rotation of a toilet tank operator's handle. One float of the combination controls a predetermined lower water level in the tank, and the other controls a second and higher level of water in the tank that may be discharged as desired.

8 Claims, 3 Drawing Sheets

SEMI-FLUSH KIT

BACKGROUND OF THE INVENTION

The instant invention relates generally to toilet tanks, and more particularly, to a semi-flush kit.

Numerous selective flush devices have been provided in the prior art that are adapted to regulate water discharge from toilet tanks. For example, U.S. Pat. Nos. 4,620,331 of Sagucio, 4,504,984 of Burns, and 4,483,204 of Troeh, all are illustrative of such prior art. While these units may be suitable for the particular purpose to which they address, they would not be as suitable for the purpose of the present invention as hereafter described. A primary object of the present invention is to provide a semi-flush kit that will overcome the shortcomings of the prior art devices.

Another object is to provide a semi-flush kit that will be of such design, as to independently flush a selective quantity of water from a toilet tank as desired for water conservation.

An additional object is to provide a semi-flush kit that will be adapted for employment with a simple high buoyancy flush valve that is probably the most common in the art.

A further object is to provide a semi-flush kit that is simple and easy to use, and and can be installed by the home owner.

A still further object is to provide a semi-flush kit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
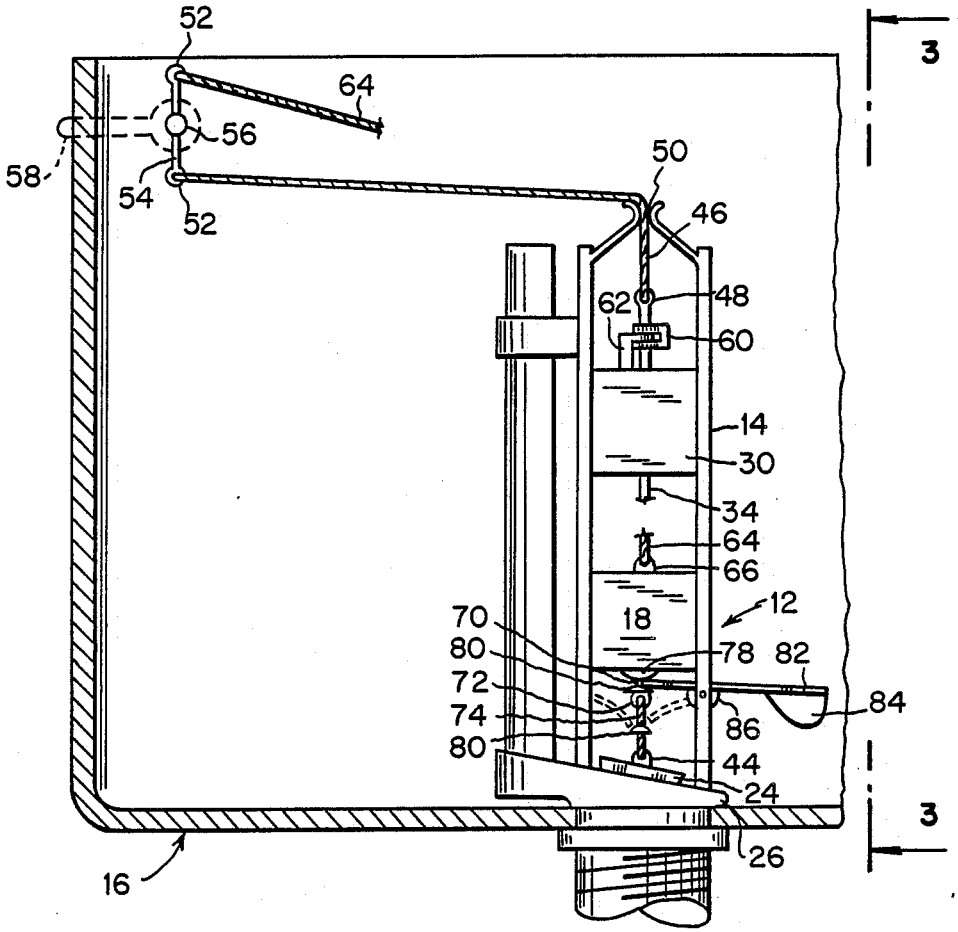
FIG. 1 is a fragmentary diagrammatic front elevational view of the invention installed in a toilet tank, with the operating handle shown in phantom.
Figure 2:
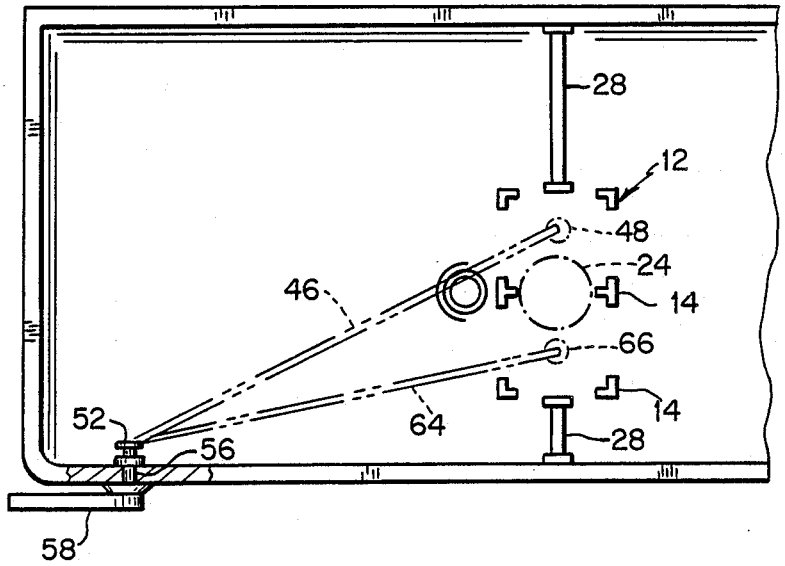
FIG. 2 is a fragmentary diagrammatic top plan view of the invention with cords and flush valve shown in phantom.

Turning now descriptively to the drawings, in which like reference characters denote like elements throughout the several views, a kit 10 is shown to include a frame 12 with vertical guide members 14 that are positioned on the bottom inside surface of a toilet tank 16. A first float 18 is provided and guided within one side of the frame 12, for controlling full water discharge of both water levels down to level 20, from the discharge pipe 22 by the lifting of the discharge valve 24 from its seat 26. Stabilizing side members 28 are secured between sides of frame 12 and the inside side surfaces of tank 16, and a second float 30 guided in the other side of the frame 12, controls the semi-flush down to water level 32, by a separate lifting of discharge valve 24.

A rod 34 is adjustably slideably secured in second float 30 that is fastened to a cord 36 by its eye 38, and cord 36 also extends through the bottom guide opening 40 of frame 12 and through one of the guide openings 42 in the bottom center of frame 12, where it is secured to an eye 42 of the discharge valve 24, for unseating valve 24 to discharge water. A second cord 46 is secured to a top eye 48 of rod 34 at one end and is guided through guide opening 50 through the upper end of frame 12, and the other end of cord 46 is fastened to an eye 52 of one side of rod 54 secured through shaft 56 of hand lever 58. A spring clip 60 of conventional design is fixedly secured to a bracket 62 that is fastened fixedly to the top of second float 30, and enables the height of second float 30 to be adjustable for controlling the water level 32 in toilet tank 16.

One end of a third cord 64 is secured to an eye 66 of the first float 18 and the other end of third cord 64 extends through guide opening 68 in the top of frame 12 and is secured to second eye 52 of the other side of rod 54. Cord 64 provides for lifting first float 18 to fully discharge the water at all levels and a rod 70 is fixedly secured in first float 18 and an eye 72 at its bottom has a fourth cord 74 secured thereto, that is guided through guide opening 76, and its other end is secured to eye 44 of valve 24 for water discharge of the water down to level 20. A bell shaped stop member 78 is fixedly secured to the bottom of first float 18 and receives the rod 70, and a second bell shaped stop member 80 is spaced from the upper stop member 78 and an end of a third-float lever rod 82 is freely received between the bell shaped members 78 and 80, for a purpose which hereinafter be described.

A small third-float 84 is fixedly secured to the other end of lever rod 82 and a bracket 86 is fixedly secured to the bottom surface of lever rod 82 and a pivot rod 88 is secured fixedly in bracket 86 and the ends of rod 88 are pivotally received in a pair of the guide members 14. This small float 84 and lever rod 82 combination, is a locking device and serves to prevent first float 18 from rising when second float 30 has been activated.

In operation when hand lever 58 is pulled down, the rod 54 pivots and pulls the cord 64 that lifts first float 18 that pulls cord 74 and lifts flush valve 24 from its seat 26, which causes a conventional full flush of water to be effected.

When the hand lever 58 is pulled upward, the rod 54 pivots in the opposite direction and pulls cord 46 which lifts the second float 30 and causes cord 36 to lift flush valve 24 from its seat 26 and cause a semi-flush of water. When the first float 18 is activated, the second float 30 does not require the locking device of the combination of small float 84 and its lever rod 82, because second float 30 will float freely with no adverse effect.

However, when the flush of water is under the control of second float 30, first float 18 must be held in place, or the valve 24 would be held open by first float 18 when it should have been closed as second float 30 reseated. This is because if locking device of the combination of small float 84 and its lever rod 82, were not employed as soon as valve 24 was upset by pulling on cord 36, than the lessening of force upon cord 74 would cause float 18 to also be released rendering the system inoperative.

The upthrust arising from the buoyancy of float 84 exerts a net force upwards pivoting the end of lever rod 82 received between the bell shaped members 78 and 80 against bell shaped member 80 urging the bell shaped member down, retaining the float 18 in place.

Figure 3:
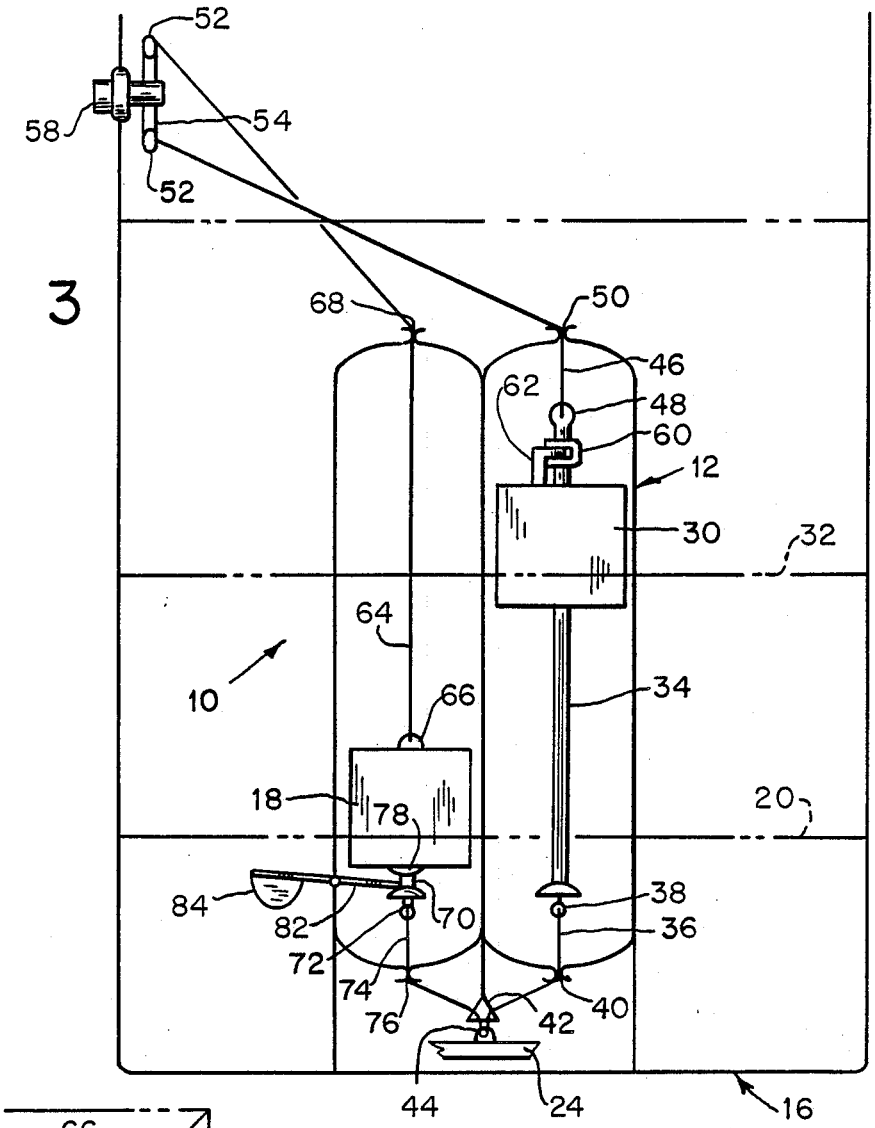
FIG. 3 is a diagrammatic side elevational view taken along line 3—3 of FIG. 1 illustrating different water levels in phantom.
Figure 6:
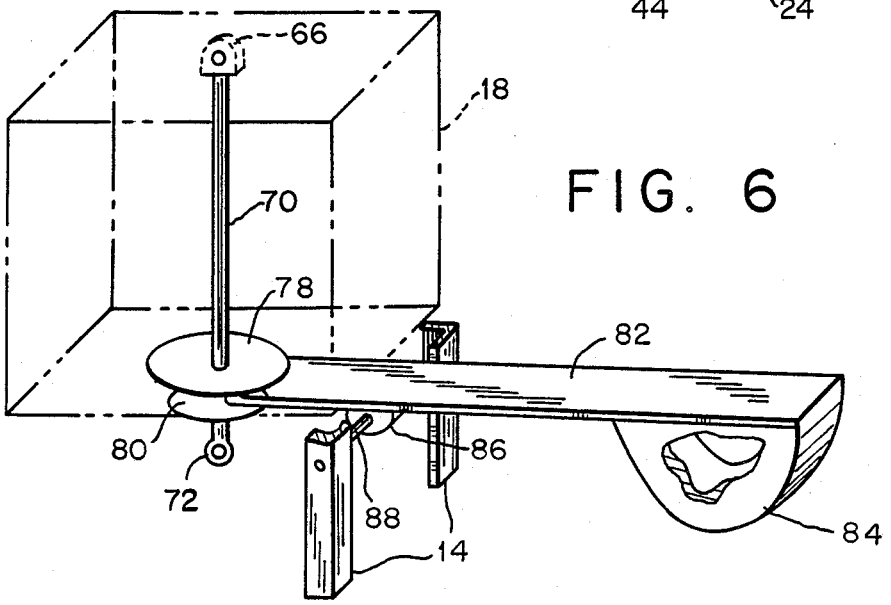
FIG. 6 is an enlarged isometric diagrammatic view of the float locking device per se with the controlled float shown in phantom.
Figure 4:
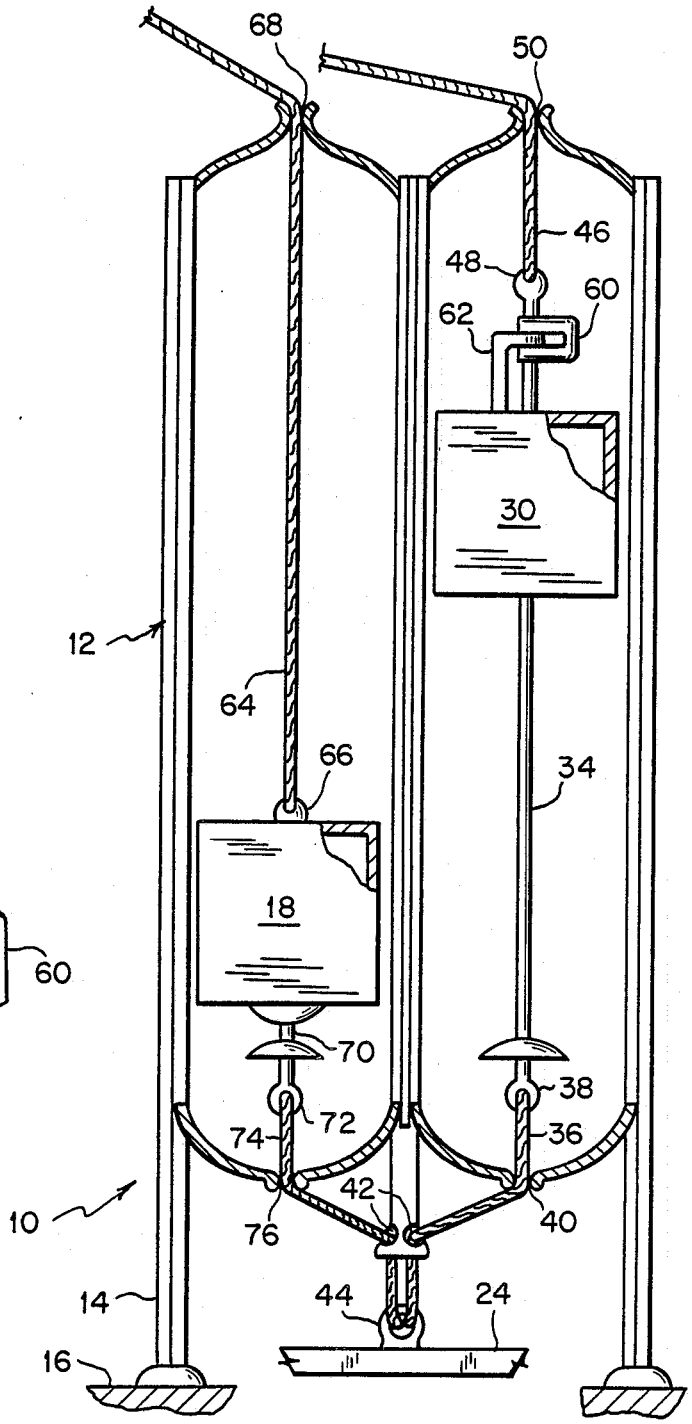
FIG. 4 is a greatly enlarged diagrammatic fragmentary view of a portion of FIG. 3, showing the mechanism in greater detail.
Figure 5:
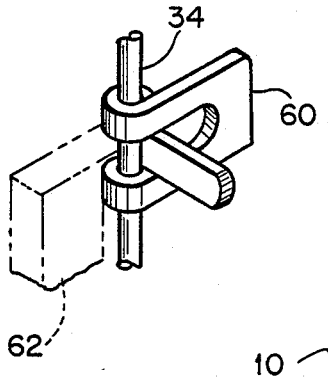
FIG. 5 is an enlarged isometric view of the thumb pressure clip for use on the rod of the invention.

As the float 18 is only raised a short distance sufficient to raise valve 44, when cord 64 is pulled, the end 70 of lever 82 remains located between the bell-shaped members 78 and 80 which gently guide the end 70 during return of the float 18 as the water level drops with progressive pivotal movement of the lever 82 back to the original position indicated in FIG. 3.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A semi-flush kit for a toilet tank of the type having a lower discharge outlet providing a valve seat and a flush valve movable from a resting, closed condition engaging the seat and closing the outlet, to an open condition, spaced apart from the seat, opening the outlet to permit water to be discharged from the tank through the outlet during flushing, the kit comprising: a flush valve, a mounting frame, a first float and a second float received in said mounting frame and each secured to the flush valve by cords extending between respective first and second floats in said flush valve, for operation independently of each other for maintaining the flush valve in open condition, spaced apart from the seat for a full and semi-flush of water, respectively, from said toilet tank, according to respective first and second, different, water levels in the toilet tank, a rod secured to an operating lever of said toilet tank, for activating said first float and said second float alternatively, and a locking device received on said first float, for operation independently of the second float, preventing said first float from rising to a position corresponding to the open condition of the flush valve when said second float has been activated.

2. A semi-flush kit as set forth in claim 1, wherein said first float and said second float are received and guided in said frame that is vertically mounted in said toilet tank, and a rod is fixedly secured in said second float and extends from ends of said second float, and a lower end of said rod is secured by cord means to said flush valve.

3. A semi-flush kit as set forth in claim 2, wherein said cord means of said second float is also received in guide opening means in a bottom of said frame, and said second float is normally elevated above and adjacent to said first float in said frame and floats on a highest water level in said tank.

4. A semi-flush kit as set forth in claim 3, wherein an upper end of said rod of said second float is secured to a second cord means secured to one end of a rod transversely through a shaft of said rod of said operating lever and when said operating lever is pivoted in one direction, said second cord means pulls said second float upward raising the rod of the second float pulling the first cord which lifts said flush valve and semi-releases a quantity of water in said tank.

5. A semi-flush kit as set forth in claim 4, wherein said first float is secured to a cord received through a guide opening in said frame and is secured to another end of said rod of said operating lever and a rod from a bottom of said first float is secured to a second cord means of said first float and said second cord means of said first float is received in guide means in said frame and is also secured to said flush valve and when said operating lever is pivoted in another direction, said first float pulls said flush valve upward and discharges all water from said tank.

6. A semi-flush kit as set forth in claim 5, wherein a bell shaped stop member is fixedly secured to a bottom wall of said first float and a second bell shaped stop member is spaced from said first bell shaped member and fixedly secured to said rod of said bottom of said first float, and a lever rod having a smaller third float fixedly secured to one end, serves as said locking means.

7. A semi-flush kit as set forth in claim 6, wherein another end of said lever rod is freely received between said first bell shaped member and said second bell shaped member and a bracket is fixedly secured to a bottom surface of said lever rod, and a pivot rod extends through said bracket and is supported in a pair of said vertical guide members of said frame, and said lever rod by means of said smaller third float that prevents said first float from ascending when said second float has been activated for a semi-flush of said tank.

8. A semi-flush kit for a toilet tank of the type having a lower discharge outlet providing a valve seat and a flush valve movable from a resting, closed condition engaging the seat and closing the outlet, to an open condition, spaced apart from the seat, opening the outlet to permit water to be discharged from the tank through the outlet during flushing, the kit comprising: a flush valve, a mounting frame, a first float and a second float received in said mounting frame guided thereby for vertical movement and each secured to the flush valve by cords extending between respective first and second floats and said flush valve, for alternative operation independently of each other for maintaining the flush valve in open condition for a full and semi-flush of water, respectively, from said toilet tank, according to respective first and second, different, water levels in the toilet tank, a rod secured to an operating lever of said toilet tank, for activating said first float and said second float alternatively by raising the respective floats and thereby the flush valve, and a locking device received on said first float, for operation independently of the second float, preventing said first float from rising to a position corresponding to the open condition of the flush valve when said second float has been activated.

* * * * *